US007832691B2

(12) United States Patent
Reibeling et al.

(10) Patent No.: US 7,832,691 B2
(45) Date of Patent: Nov. 16, 2010

(54) SYSTEM AND METHOD FOR TRAIN OPERATION APPROACHING GRADE CROSSINGS

(75) Inventors: Charles A. Reibeling, Ridgewood, NY (US); Gerhard F. Meyer, Oceanside, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 12/355,677

(22) Filed: Jan. 16, 2009

(65) Prior Publication Data

US 2009/0184214 A1 Jul. 23, 2009

Related U.S. Application Data

(60) Provisional application No. 61/021,848, filed on Jan. 17, 2008.

(51) Int. Cl.
*B61L 1/02* (2006.01)

(52) U.S. Cl. ..... 246/125; 246/293; 246/473.1; 246/113; 246/117; 246/126

(58) Field of Classification Search ..... 246/113, 246/114 R, 115, 117, 125, 126, 127, 293, 246/292, 473.1
See application file for complete search history.

(56) References Cited

U.S. PATENT DOCUMENTS 5,735,492 A * 4/1998 Pace ..... 246/125
5,864,304 A * 1/1999 Gerszberg et al. ..... 340/903
5,954,299 A * 9/1999 Pace ..... 246/293
6,340,139 B1 * 1/2002 Hilleary ..... 246/292
6,416,021 B2 * 7/2002 Greene, Jr. ..... 246/294
6,836,221 B1 * 12/2004 Boddie et al. ..... 340/901
7,075,427 B1 * 7/2006 Pace et al. ..... 340/539.22
7,195,211 B2 * 3/2007 Kande et al. ..... 246/473.1
7,575,202 B2 * 8/2009 Sharkey et al. ..... 246/293
2002/0185571 A1 * 12/2002 Bryant et al. ..... 246/125
2005/0284987 A1 * 12/2005 Kande et al. ..... 246/125
2008/0073466 A1 * 3/2008 Mardirossian ..... 246/125
2008/0183306 A1 * 7/2008 Ashraf et al. ..... 700/4
2009/0184214 A1 * 7/2009 Reibeling et al. ..... 246/125

* cited by examiner

*Primary Examiner*—S. Joseph Morano
*Assistant Examiner*—Jason C Smith
(74) *Attorney, Agent, or Firm*—DeMont & Breyer, LLC

(57) ABSTRACT

A system and method that enables trains to rapidly accelerate through grade crossings from station stops or civil speed restrictions is disclosed. In some embodiments, equipped trains and grade-crossing controllers communicate wirelessly to address operational limitations pertaining to the grade crossings. In conjunction with the train's equipment, conventional crossing controllers are augmented with a communications capability and logic to accept commands to operate in a "Prediction" mode or a "Motion-Sensing" mode. The Prediction mode is the default operating mode for conventional constant-warning grade-crossing prediction controllers. The Motion-Sensing mode is an operating mode whereby the crossing is actuated as soon as an approach circuit detects train motion.

11 Claims, 7 Drawing Sheets

SYSTEM AND METHOD FOR TRAIN OPERATION APPROACHING GRADE CROSSINGS

STATEMENT OF RELATED CASES

This case claims priority of U.S. Provisional Patent Application U.S. 61/021,848 filed Jan. 17, 2008 and incorporated by reference herein.

FIELD OF THE INVENTION

The present invention relates to railways in general, and, more particularly, to grade crossings and grade-crossing predictor controllers.

BACKGROUND OF THE INVENTION

At a highway-rail grade crossing (or simply a "grade crossing"), a rail system crosses a road network at the same level or "grade." This crossing is somewhat unique in that at this crossing, two distinct transportation modalities, which differ in both the physical characteristics of their traveled ways and their operations, intersect.

The number of grade crossings has grown with the growth in highways. In 2005, there were 248,273 total intersections of vehicular and pedestrian travel-ways with railroads in the United States. This equates to approximately 2.4 crossings per railroad line mile.

In the early days of railroads, safety at grade crossings was not considered to be much of an issue. Trains were few in number and slow, as were highway travelers who were usually on foot, horseback, horse-drawn vehicles, or bicycles. This changed, however, with the advent of the automobile in the early 1900s.

In addition to the possibility of a collision between a train and a highway user, a grade crossing presents the possibility of a collision that does not involve a train. Non-train collisions include rear-end collisions in which a vehicle that has stopped at a crossing is hit from the rear by another vehicle; collisions with fixed objects such as signal equipment or signs; and non-collision accidents in which a driver loses control of the vehicle. These non-train collisions are a particular concern with regard to the transportation of hazardous materials by truck and the transportation of passengers, especially on school buses.

FIG. 1 depicts a conventional highway-rail grade crossing, generally indicated by reference numeral 100, at the intersection of road 102 and railroad tracks 104. Associated with grade crossing 100 is a warning system, which provides train detection and crossing control.

The train detection is provided by track circuit 116 (and grade-crossing predictor controller 106). The track circuit is based upon closed-circuit fail-safe design principles. An interruption or disturbance in the circuitry or in the signals impressed on the rails to detect trains will activate crossing warning devices that are a part of the crossing control system.

The track circuit includes approach circuits 112 and 114 and island circuit 110. Approach circuit 112 is defined between shunt 118A and lead 120A. Approach circuit 114 is defined between shunt 118B and lead 120B. Island circuit 110 is a region of track circuit 116 that is between leads 120A and 120B. The same leads 120A and 120B are used for the island and the approach circuits, although different signals are used.

Crossing control is provided by crossing warning devices 122 (and grade-crossing predictor controller 106). Crossing warning devices 122 provide appropriate warning to vehicles and pedestrians, typically by means of flashing lights 124, movable barrier gates 126, and audible devices, such as bells (not depicted). Warning devices 122 are typically placed on both sides of track 104 and adjacent to roadway 102.

In addition to the aforementioned track circuits (for train detection) and warning devices (for crossing control), the warning system includes grade-crossing predictor controller 106. This controller provides crossing control, train detection, as well as a recording functionality (in some systems) for the grade crossing.

Controller 106 is disposed within weatherproof housing 108, which is usually sited near railroad track 104. Typically, controller 106 includes a display, such as touch screen display that provides a user interface for programming/configuring the controller, such as during initial setup. Controller also typically includes a central processing unit, track modules (e.g., software, etc.) for monitoring track 104, crossing control modules (e.g., software, etc.) for controlling the crossing warning devices 122, and a recorder (not depicted) for recording events and conditions at grade crossing 100. In some prior-art grade-crossing systems, controller 106 is capable of two-way communications via wireless telecommunications devices 128 (e.g., transceiver, antenna, etc.). For example, controller 106 might receive inquiries from and/or transmit information to a railway operations center in conjunction with telecommunications equipment 128.

In addition to any other tasks, controller 106 monitors at least (1) the portion of railroad track 104 that intersects road 102 within island circuit 110 and (2) those portions of railroad track 104 within approach circuits 112 and 114 (to the left and right of the island circuit). When controller 106 detects the presence of a train in approach circuits 112 or 114, or in island circuit 110, the controller activates the flashing lights 124 and the audible devices and causes gates 126 of crossing warning devices 122 to be lowered.

It is required that railroad track circuits actuate active warning devices a minimum of 20 seconds before arrival of a train where trains operate at speeds of 20 mph or higher. Conventional grade-crossing predictor controllers, such as controller 106, are designed to provide a constant crossing warning time for approaching trains. These devices, which are the standard means for train detection in the railroad industry, are tailored for a train approaching at track speed. If, however, a train were to accelerate within approach circuits 112 or 114, the controller will provide a poor estimation of the estimated-time-of-arrival (ETA) and the warning times will not be consistent. The estimate will be even worse when conditions such as a rusty rail or ballast problems are present.

As a consequence, trains that have stopped at a station or trains operating under a restriction near crossings are prevented by operating rules from accelerating at their maximum rate until they have passed nearby highway crossings. Vehicular traffic delays result while the crossings remain actuated until the train passes. This delay is magnified when there are several highway crossings in proximity, as often occurs in urban areas.

As such, from the community viewpoint, there is a concern over delays, congestion, and the impact on emergency vehicle response (due to trains blocking street crossings). Even so, communities often impose speed restrictions on trains, which of course exacerbates delays because trains take longer to clear crossings. From the railroad viewpoint, speed restrictions are undesirable because of the delays incurred by trains as they slow down to pass through a community. As a consequence of these issues, the current practice of existing railroads is to consolidate and close grade crossings where feasible.

It would be advantageous to provide a method for reducing both rail and automotive traffic delays due to the presence of grade crossings.

SUMMARY OF THE INVENTION

The present invention enables trains to rapidly accelerate through grade crossings from station stops or civil speed restrictions, thereby reducing rail and automotive traffic delays.

The illustrative embodiment of the invention is a system of equipped trains and grade-crossing controllers that communicate wirelessly to address operational limitations pertaining to the grade crossings. The system on-board the train includes: a precise location-determining system, wireless communications capability, an on-board database for location determination, an on-board database for station configuration, an on-board database for wayside configuration, a processor running algorithms to compute acceleration and movement predictions, and a crew display model. All these items, with the exception of the latter two (i.e., the processor running software to computer acceleration and movement predictions to compare against crossing warning times and the crew display model) are normally present on a train.

In conjunction with the train's equipment, wayside features include conventional crossing controllers that are augmented with a communications capability and logic to accept commands to operate in a "Prediction" mode or a "Motion-Sensing" mode.

The Prediction mode is the default operating mode for conventional constant-warning grade-crossing prediction controllers. In this mode, an estimate of a (constant speed) train's ETA is made and the crossing is actuated to meet the configured warning time. The Motion-Sensing mode is an operating mode whereby the crossing warning system is actuated as soon as an approach circuit detects train motion. The approach circuits are long enough to detect trains operating at the maximum speed allowed by the track. A controller placed in Motion-Sensing mode detects an approaching train that is accelerating from a stop or low speed and actuates the crossing warning devices to achieve the configured warning time.

Additionally, wireless communications capability that provides coverage in the area of the station stop and the affected highway crossings is required for message exchanges.

In operation, a train that is stopped at a station sends a command via the communications network to each of the defined crossing controllers downstream. The command changes the operating mode of these controllers from the Prediction Mode to the Motion-Sensing mode. A display is provided to the locomotive engineer indicating whether it is permissible to accelerate fully or to operate per rule at a low speed until a minimum warning (crossing actuation) time has been achieved at the crossing that is being approached. The default indication is to not allow full acceleration.

The train plots a time-space diagram with an estimate of the crossing warning times of the downstream crossings, based on its location, speed and an allowed acceleration. If the minimum warning time can be achieved, then the indication to the crew can be upgraded to permit full acceleration. In the absence of receiving a positive confirmation from a crossing controller permitting full acceleration, the display will indicate that speed is restricted until that crossing has been passed. Once a train passes a crossing, another command is sent to crossing controller to return to the Prediction mode.

The illustrative embodiment provides an efficient way to activate highway-rail grade crossing systems via equipment that is on-board a train and that communicates with the highway-rail grade crossing. The on-board system activates the crossing in a way that permits the train to fully accelerate and not be required to maintain a constant speed through multiple crossings. This can ameliorate delays to local pedestrian, highway/road, and rail traffic.

DETAILED DESCRIPTION

Figure 1:
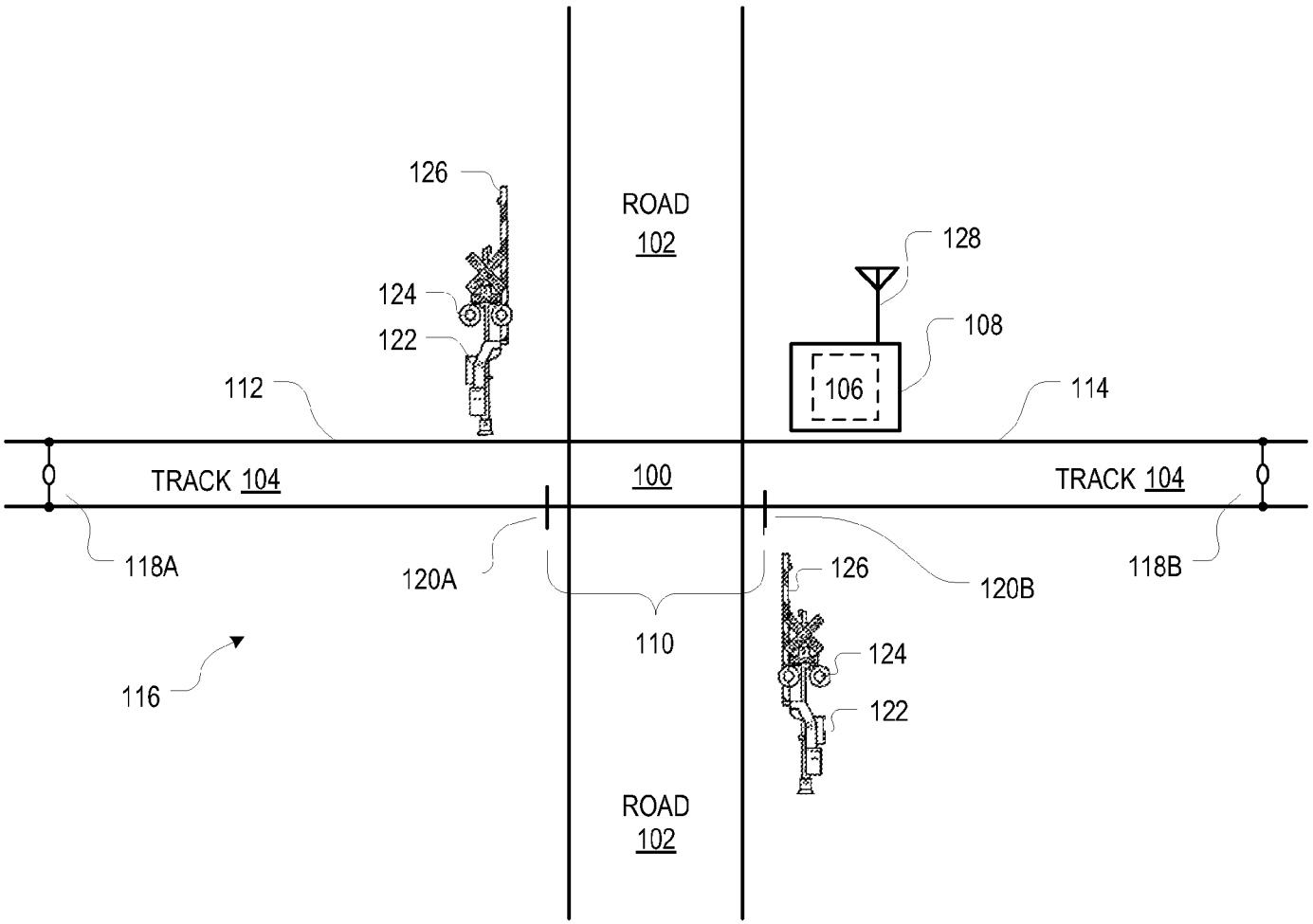
FIG. 1 depicts a highway-rail grade crossing and associated equipment, as is known and used in the prior art.
Figure 2:
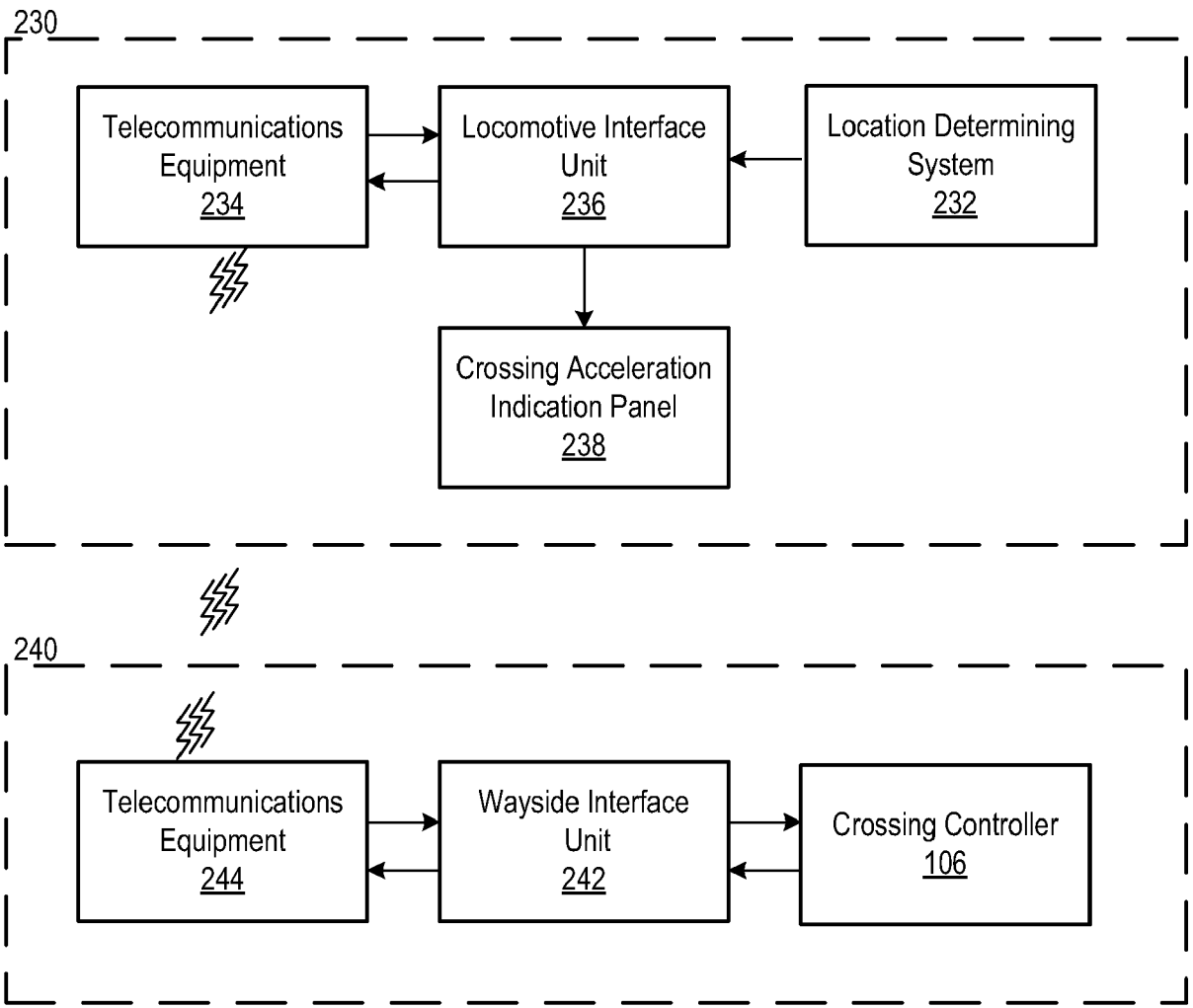
FIG. 2 depicts a system for crossing activation in accordance with the illustrative embodiment of the present invention.

FIG. 2 depicts system 200 for crossing activation in accordance with the illustrative embodiment of the present invention. System 200 includes both onboard system 230 and wayside system 240.

In the illustrative embodiment depicted in FIG. 2, equipment included in onboard system 230 comprises:

Location-determining system 232. The location-determining system is typically satellite based (e.g., GPS or DGPS, etc.) optionally enhanced by an inertial device (e.g., accelerometers, gyroscopes, etc.). The reason for the optional inclusion of inertial devices is that system 232 must be capable of dead reckoning in areas in which there is unreliable or no GPS coverage. Thus, output from one or more inertial sensors are blended with available GPS or DGPS and compared against an onboard track database to determine train location. Those skilled in the art will know how to use GPS or DGPS in conjunction with inertial sensors to determine the location of a train on a railway.

Telecommunications equipment 234. The telecommunications equipment comprises a transceiver, antenna and ancillary software.

Locomotive interface module 236. The locomotive interface module includes a wheel tachometer interface, sensors (e.g., slow-speed select, throttle, generator field, forward/reverse, wheelslip warning, engine run, dynamic brake setup, excitation, etc.), brake pipe pressure sensor, full service brake and emergency brake penalty interfaces, PCS (pneumatic control switch) interface, and enforcement enable interface. Locomotive interface module 236 also provides a display for various sensor readouts and for providing graphical displays.

Crossing Acceleration Indication Panel 238.

The functional requirements for on-board system 230 include:

Location determination.

Position/speed/direction reporting.

Maintaining the track database for use in location determination.

Maintaining acceleration curve data.

Inclusion of algorithms for acceleration/movement/location estimates and for crossing-activation.

Implementing a message interface to/from wayside system 240; and

Sending crossing activation commands over the communications interface to change the operating mode of the predictor controller to Prediction or Motion Detection and accept acknowledgment from wayside system 240.

Accepting wayside messages for crossing actuation status and providing an acknowledgement.

It is notable that with the exception of crossing acceleration indication panel 238, and certain software (e.g., crossing activation software, telecommunications software, etc.), the equipment included in onboard system 230 is typically present on existing trains.

In the illustrative embodiment that is depicted in FIG. 2, equipment included in wayside system 240 comprises:

Conventional grade-crossing prediction controller 106.

Wayside interface unit 242.

Telecommunications equipment 244, including transceiver, antenna and ancillary software.

The functional requirements for wayside system 240 include:

Implementing a message interface using agreed upon communications protocol to/from the telecommunications equipment 234 aboard the locomotive (e.g., Internet Protocol, ATCS Spec 200 Protocol, etc.).

Accepting commands over the communications interface to change the operating mode of crossing controller 106 to Prediction or Motion Detection and provide acknowledgement to the requesting locomotive.

Actuating relay outputs to change controller operating mode upon receipt of a valid command from the locomotive.

Monitoring the crossing (XR) relay and determine when it has been actuated.

Sending a message to the requesting locomotive indicating crossing actuation status and accepting acknowledgement.

Thus, in wayside system 240, a conventional crossing controller (i.e., controller 106) is augmented with an appropriate communications capability and logic to accept commands to operate in Prediction mode or Motion mode, as defined herein. Prediction mode is the default operating mode for conventional constant-warning grade-crossing prediction controllers where an estimate of a (constant speed) locomotive's ETA is made and the crossing is actuated to meet the configured warning time. Motion sensing mode is a "new" operating mode whereby the crossing is actuated as soon as an approach circuit detects train motion. The approach circuits are long enough to detect trains operating at the maximum speed allowed by the track. A controller placed in motion sensing mode should easily detect an approaching train that is accelerating from a stop or low speed and actuate the crossing warning devices to achieve the configured warning time.

Figure 3:
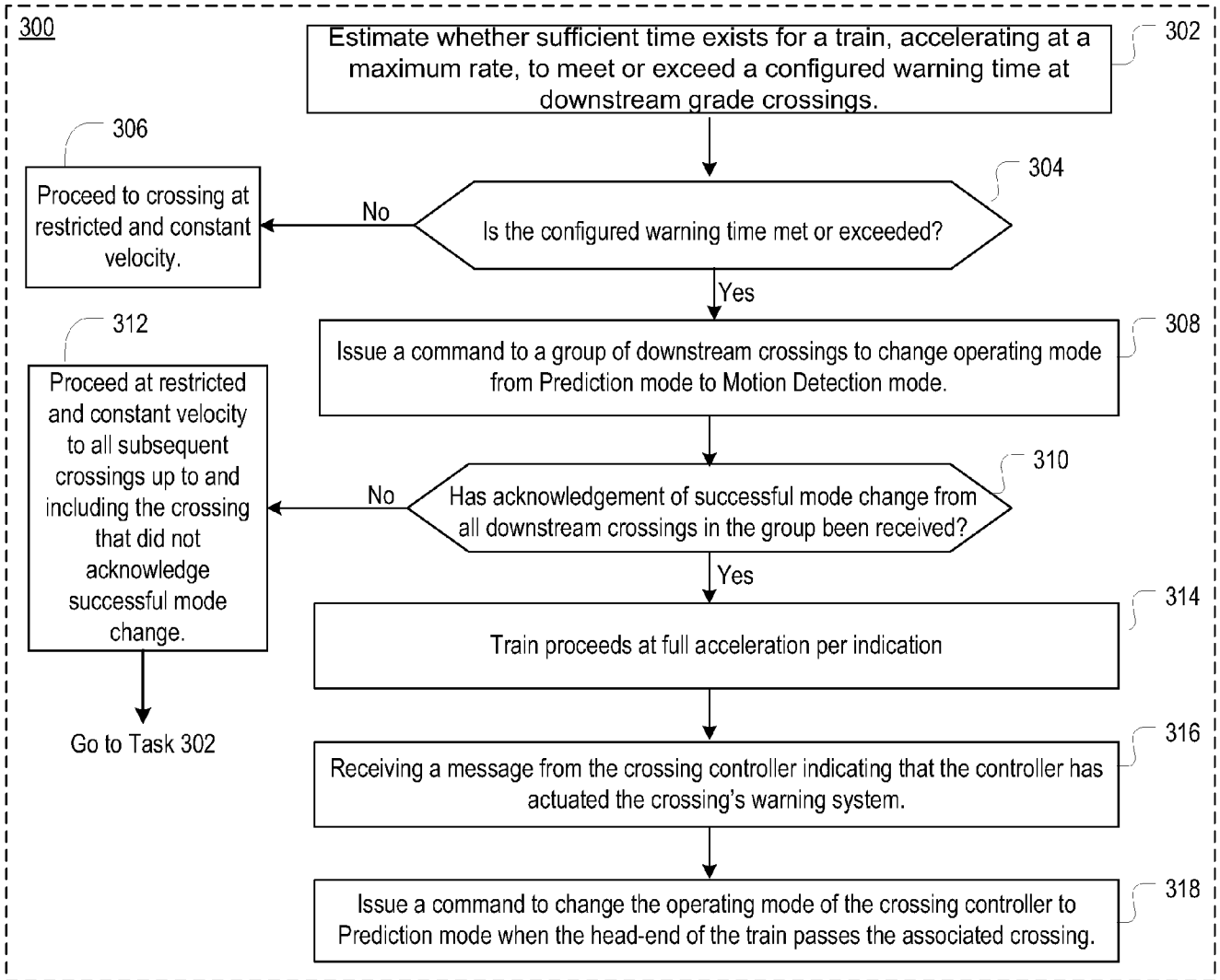
FIG. 3 depicts a method in accordance with the illustrative embodiment of the present invention.

FIG. 3 depicts method 300 in accordance with the present invention. According to the method, an estimate is provided as to whether sufficient time exists for a train, which is accelerating at a maximum allowable rate, to meet or exceed a configured warning time at a group of downstream grade crossings, as per task 302. This estimate is typically performed via software that is running on a processor that is on the train.

Query, at task 304, if the warning time is met or exceeded. If not, the train proceeds to the subsequent crossing at a restricted and constant velocity, as per task 306. If the warning time is met or exceeded, then the train issues a command, as per task 308, to change the operating mode of the crossing controller from Prediction mode to Motion-sensing mode.

Query, at task 310, whether acknowledgement of successful mode change has been received from all downstream crossings in the group. If not, the train proceeds at restricted and constant velocity to all subsequent crossings up to and including the crossing that did not acknowledge successful mode change, as per task 312. If acknowledgment from all downstream crossings in the group has been received, the train can proceed at full acceleration, as per task 314.

According to task 316, the train receives a message from a crossing controller when that controller actuates the crossing's warning system. The train issues a command to change the operating mode of the crossing controller back to Prediction mode when the head-end of the train passes the associated crossing, as per task 318.

FIGS. 4-7 depict the implementation of method 300 for various operating scenarios via time-space diagrams and other information. Shown in each of these Figures are: a "Grade Crossings" axis, a "Crossing Mode Status" axis, and a "Crossing Actuation Time" axis. Time increases to the "right" along each axis.

The appearance of a grade crossing at a specific location along the "Grade Crossings" axis is indication of the predicted time at which the head end of the train reaches a specific grade crossing. The predicted time is based on a certain velocity/acceleration profile for the train, which is depicted in each Figure.

Annotations along the "Crossing Mode Status" axis indicate that the operational status of the controller is changed to the indicated status (i.e., "motion" or "prediction" mode) for the specified controller(s) at that time. The "Crossing Actuation Status" indicates the predicted time at which the warning system (i.e., gates, lights, etc.) for a specific crossing will be actuated based on the given velocity/acceleration profile.

An indication of the required configured warning time or "CWT" is also provided in each Figure for each crossing. The "length" or "span" of the CWT represents a elapsed time, which is the required warning time. A determination of whether the estimated warning time for each crossing is at least as long as the CWT for that crossing can be determined. This is performed by comparing the CWT for a particular crossing to the gap between the estimated time-of-actuation of a specific crossing's warning system and the estimated time that the train reaches that grade crossing. This "gap" represents elapsed time. As a consequence, if this "gap" or elapsed time is at least as large as the CWT, then the required warning time at the crossing is met (or exceeded).

Figure 4:
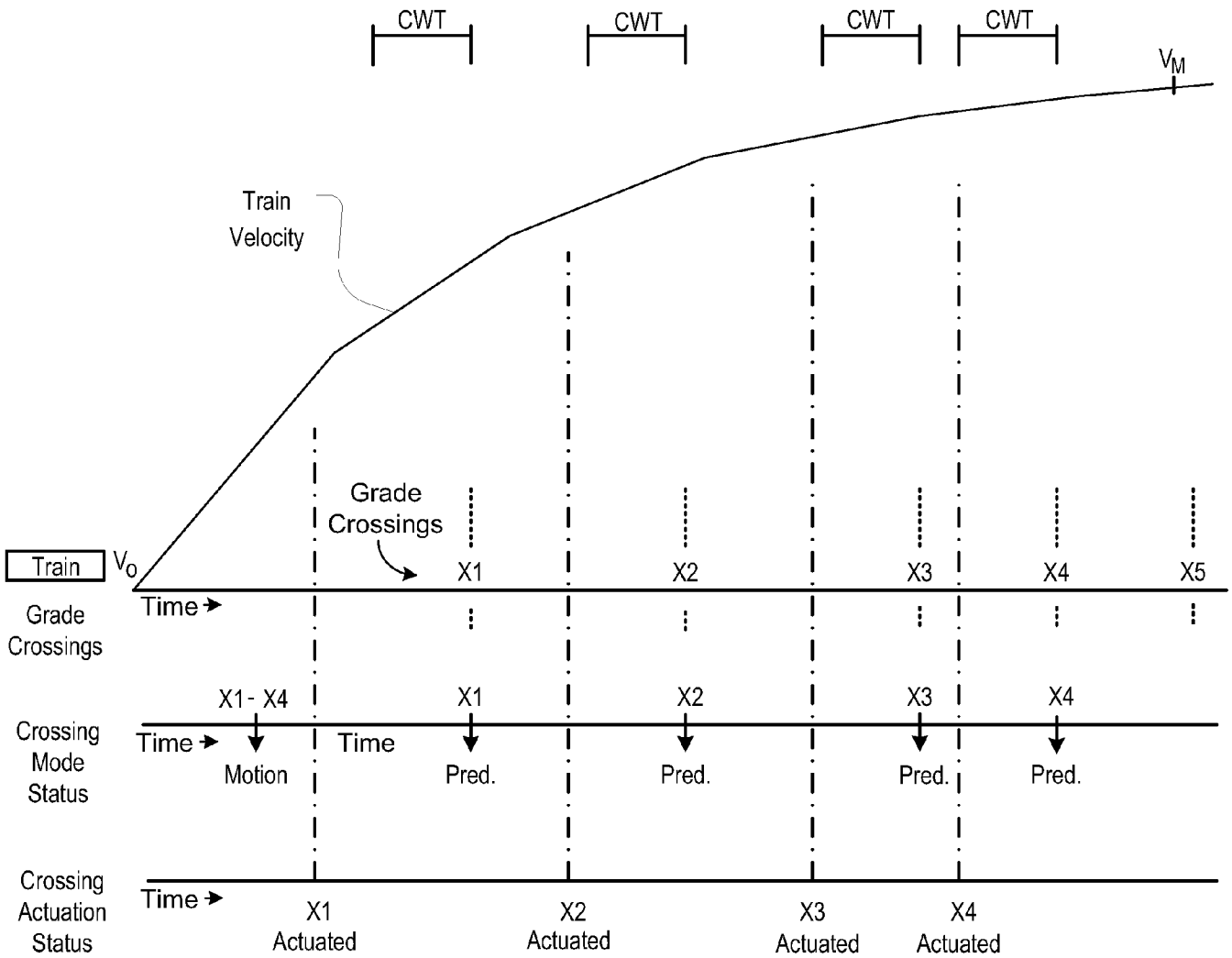
FIG. 4 depicts an operating scenario in application of the method wherein normal acceleration is permitted for all crossings.

FIG. 4 depicts a situation wherein normal acceleration is permitted for all crossings. The scenario for FIG. 4 is as follows:

1) A train comes to a stop at a station.

2) An initial indication to the crew is that normal acceleration is not permitted.

3) A projected plot of the train using a maximum acceleration curve shows that given the train's ETA at crossings X1-X4 and estimated warning actuation times (as shown on the "Crossing Actuation Status" axis), the arrival time will provide at least the configured warning time CWT at each such crossing.

4) The plot shows train velocity in excess of $V_M$, which is a configurable parameter, at crossing X5. As a consequence, no session will be established; the crossing remains in Prediction Mode for train passage.

5) A command is issued to crossings X1-X4 to change operating mode from Prediction Mode to Motion Detection mode.

6) Receipt of an acknowledgement of successful mode change from all crossings X1-X4 will cause an upgrade of the indication to crew that normal acceleration is permitted.

7) Train starts moving (crew may accelerate fully per indication if they choose).

8) When in Motion Detection Mode, approach circuit will actuate the crossing as soon as train movement is sensed.

9) When the crossing controller senses that a crossing has been actuated, a message is sent to the train indicating that status.

10) Once the head-end of the train passes the crossing, a command goes out to the crossing to change mode to Prediction Mode.

Figure 5:
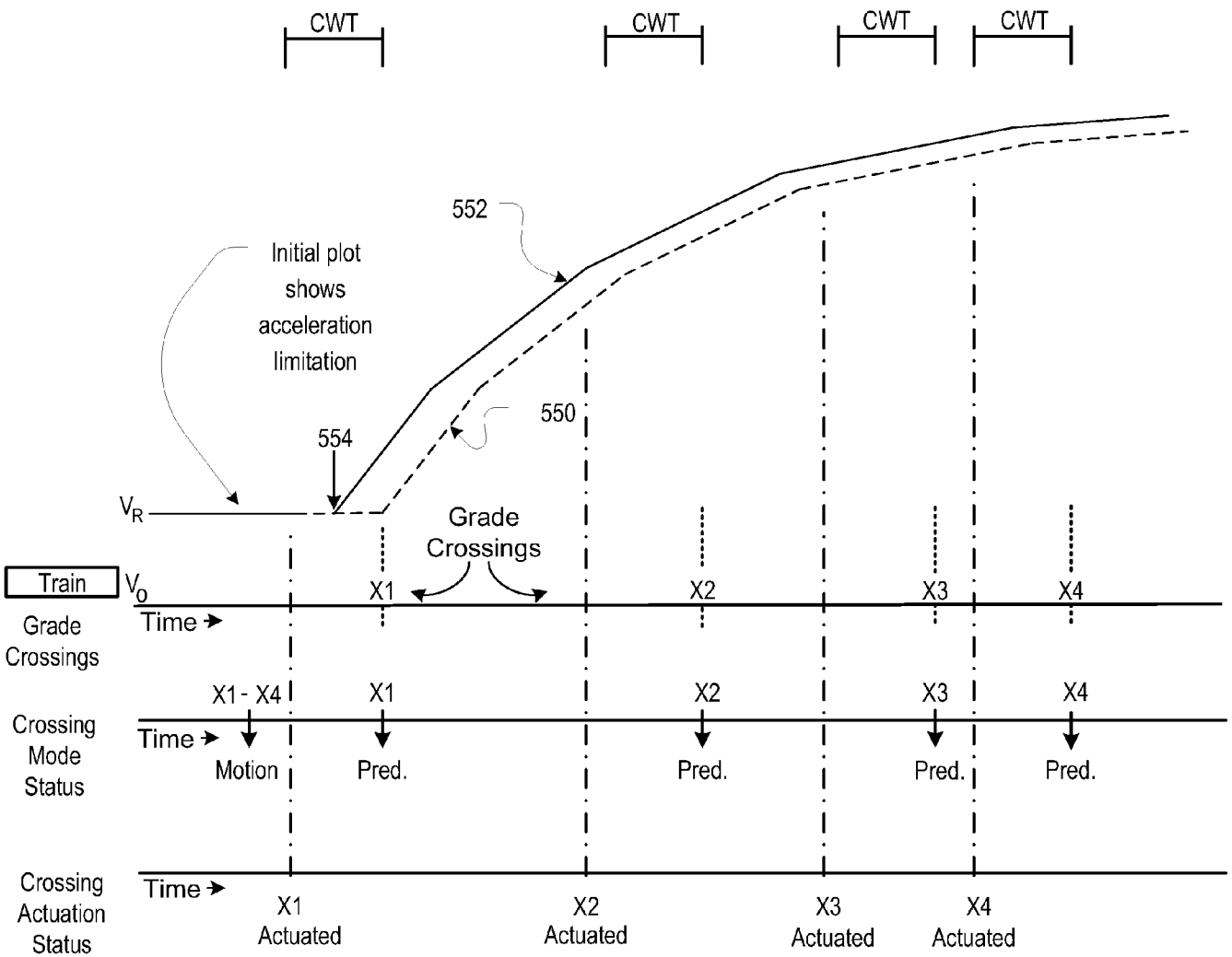
FIG. 5 depicts an operating scenario in application of the method wherein there is an acceleration limit on the first crossing until the crossing indicates configured warning time normal acceleration on subsequent crossings.

FIG. 5 depicts a situation wherein there is an acceleration limit on the first crossing until the crossing indicates configured warning time normal acceleration on subsequent crossings. The scenario for FIG. 5 is as follows:

1) The train comes to a stop at a station.

2) The initial indication to crew that normal acceleration is not permitted.

3) The initial projected plot of train using the acceleration curve shows that the configured warning time cannot be provided for the first crossing.

4) The initial plot of the train is updated by plot 550, which assumes that the train is operating at restricting approach speed $V_R$ up to the first crossing (restricting approach assumption).

5) Command goes out to crossings X1-X4 to change operating mode from Prediction mode to Motion Detection mode. (Command for Motion Detection mode is sent to X1 as well.) Responses are received from all crossings.

6) The train starts moving.

7) Once crossing X1 determines that the crossing has been actuated, a message is sent to the train indicating that status.

8) After receipt of the message indicating that crossing X1 has been activated, a new projected plot 552 of train using the acceleration curve is made. Positive confirmation from the downstream crossing(s) is required if the initial (conservative) estimate does not indicate sufficient warning time.

9) Upon confirming (at 554) that ETA at full acceleration at the initial crossing and at the downstream crossings meet configured warning times, the indication to the crew is upgraded to permit normal acceleration.

10) If the train cannot confirm that the downstream configured warning times will be met (assuming the train starts normal acceleration), the indication limiting acceleration remains as is. Computation is performed every second, eventually, the ETA on the restricting approach should meet the configured warning time and the crew indication is upgraded to permit full acceleration.

Figure 6:
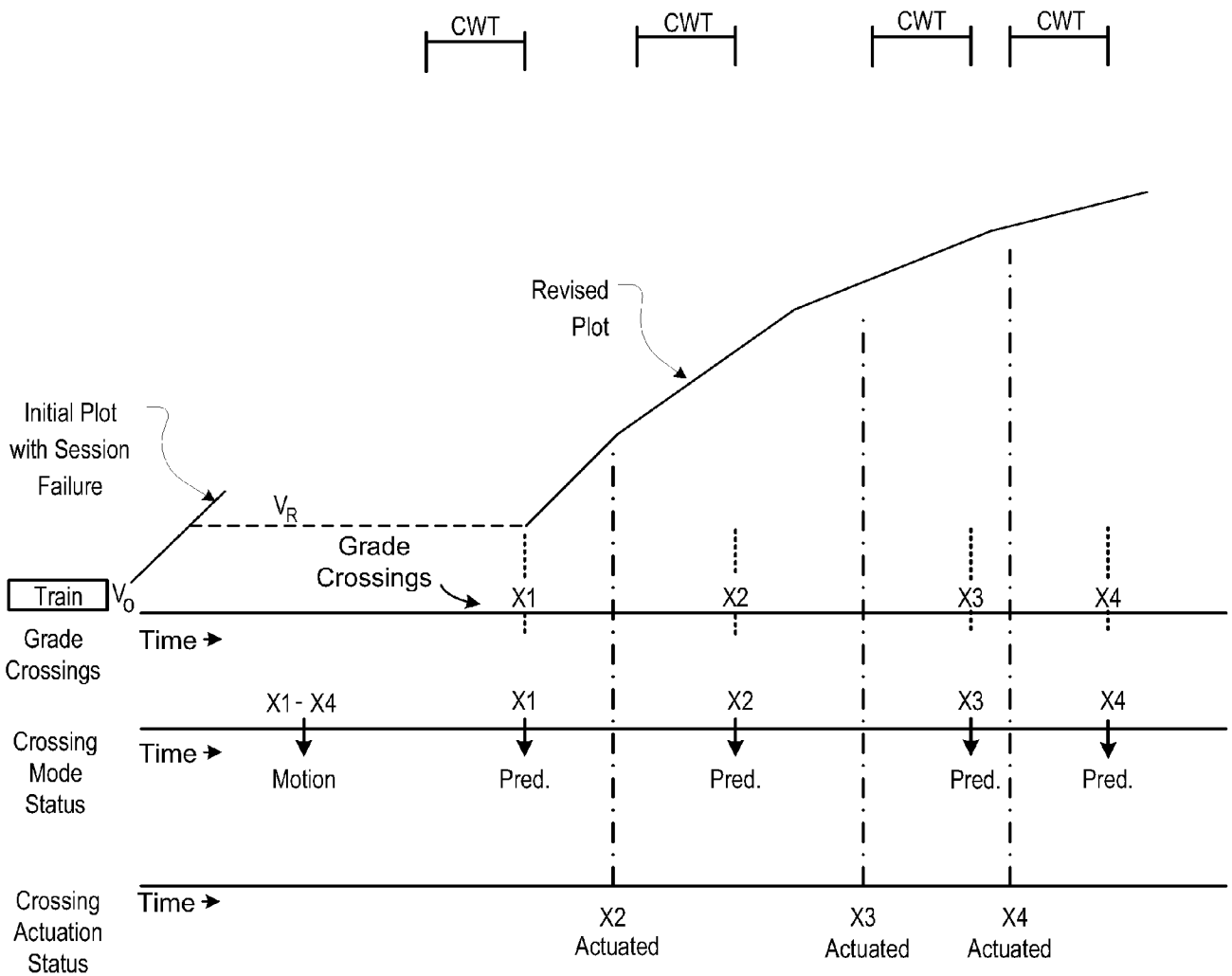
FIG. 6 depicts an operating scenario in application of the method wherein there is a failed session for a first crossing.

FIG. 6 depicts a situation wherein there is a failed session for first crossing X1. The scenario for FIG. 6 is as follows:

1) The train comes to a stop at a station.

2) The initial indication to crew is that normal acceleration is not permitted.

3) A projected plot of train using acceleration curve shows that sufficient time exists for an accelerating train to provide the configured warning time at the crossing.

4) A command goes out to crossings X1-X4 to change operating mode from Prediction mode to Motion mode.

5) Acknowledgement received from crossings X2-X4, crossing X1 sent a negative acknowledgement or did not respond.

6) A revised plot of train (plot allows acceleration up to restricted speed $V_R$, uses that speed limit until end of crossing X1, and then resumes normal acceleration) shows sufficient time for arrival after configured warning time for subsequent crossings X2-X4.

7) After passing the last crossing that limited acceleration (X1 in this example), an upgraded indication is provided to crew that normal acceleration is permitted.

8) Even though a session failure occurred for crossing X1, the command to change mode back to Predicted mode is still sent.

Figure 7:
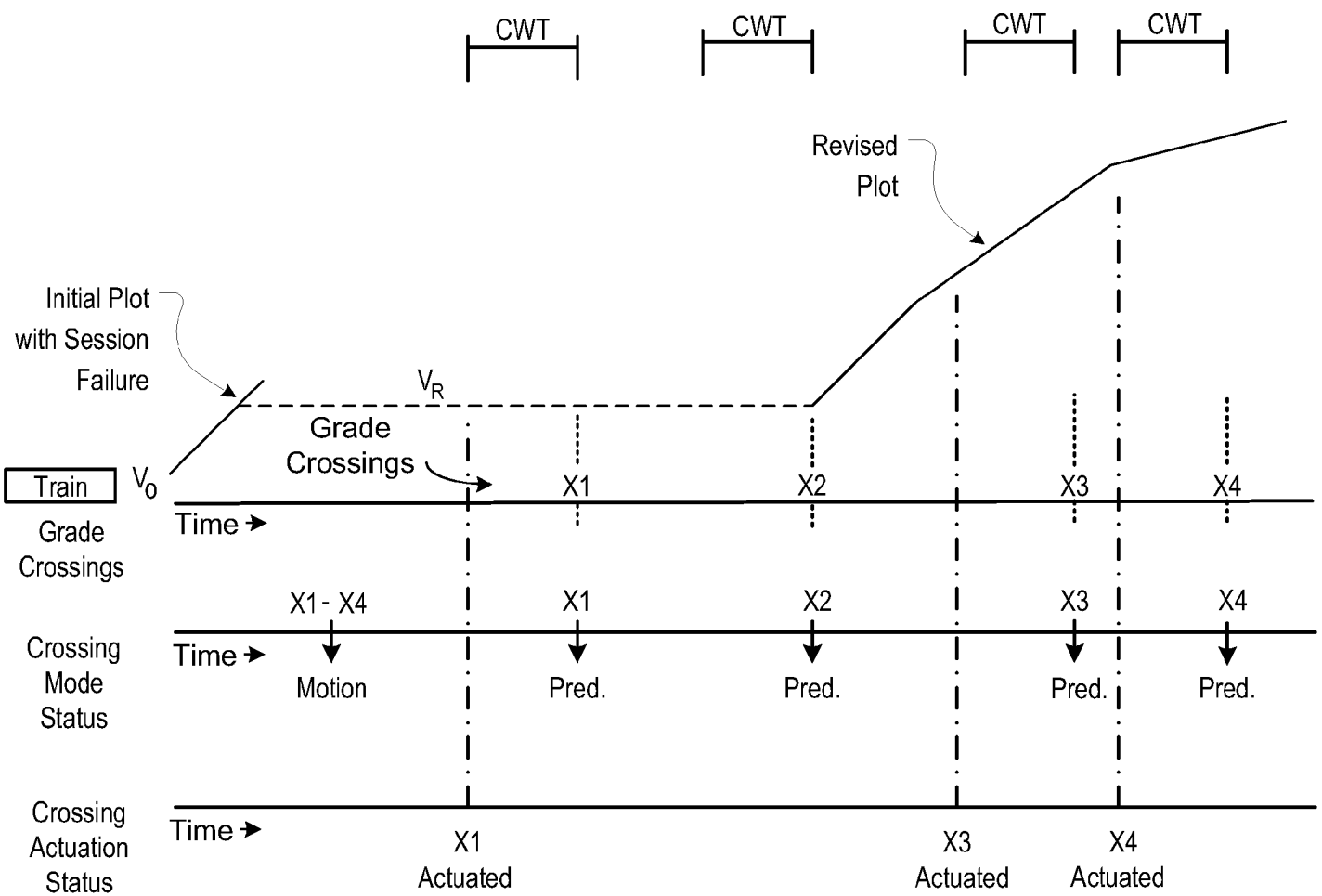
FIG. 7 depicts an operating scenario in application of the method wherein there is a failed session for a downstream crossing.

FIG. 7 depicts a situation wherein there is a failed session for a downstream crossing. The scenario for FIG. 7 is as follows:

1) The train comes to a stop at a station.

2) The initial indication to crew is that normal acceleration is not permitted.

3) A projected plot of train using the acceleration curve shows that sufficient time exists for an accelerating train to provide the configured warning time at all crossings.

4) A command goes out to crossings X1-X4 to change operating mode from Prediction mode to Motion mode.

5) An acknowledgement is received from crossings X1, X3, and X4; crossing X2 sent a negative acknowledgement or did not respond.

6) A revised initial plot of train shows sufficient time for arrival after configured warning time for subsequent crossings (X3-X4); (plot allows acceleration up to restricted speed $V_R$, uses that speed limit until end of crossing X2 (failed session), and then resumes normal acceleration).

7) Even though crossing X1 indicates that it has been actuated for the configured warning time, the crew indication still limits acceleration since a downstream crossing session failed.

8) Even though a session failure occurred for crossing X2, the command to change mode to Predicted mode is still sent.

9) After passing last crossing that limited acceleration (X2 in this example), an upgraded indication is provided to crew that normal acceleration is permitted.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A system for use in conjunction with a train, railroad-highway grade crossings and grade-crossing warning systems associated therewith, wherein the system comprises a first onboard system, wherein when the train is stopped upstream of a first grade crossing or under civil speed restrictions upstream of the first grade crossing, the first onboard system:

(a) estimates a crossing warning time for each of a plurality of downstream grade crossings, including the first grade crossing, based on train location, grade-crossing location, train speed, and a maximum allowed acceleration;

(b) compares the estimated crossing warning times with a configured warning time for each of the grade crossings;

(c) issues, when the estimated crossing warning times meet or exceed the configured warning times, a command to a wayside interface unit for each of the downstream grade crossings to change an operating mode from a conventional operating mode to a motion-sensing mode in which the associated grade-crossing warning system is activated as soon as an associated approach circuit detects motion of the train, irrespective of any amount by which a resulting crossing warning time exceeds the configured warning time; and (d) provides an indication that the train is permitted to accelerate at the maximum allowed rate when acknowledgement of successful mode change is received from the wayside interface unit of each of the downstream grade crossings.

2. The system of claim 1 and further wherein the first onboard system provides an indication that the train is not permitted to accelerate at the maximum rate to the first grade crossing when acknowledgment of successful mode change is not received from the wayside interface unit of all downstream grade crossings.

3. The system of claim 1 and further wherein when the first onboard system does not receive an acknowledgment of successful mode change from the wayside interface unit of one of the downstream grade crossings, the first onboard system provides an indication that the train is not permitted to accelerate at the maximum rate at least until the train passes the one downstream grade crossing.

4. The system of claim 1 and further wherein the first onboard system issues a command to the wayside interface unit to change the operating mode back to the conventional mode, when, at the time the message is received, the crossing controller is operating in the motion-sensing mode.

5. The system of claim 4 and further wherein the first onboard system issues the command to change the operating mode back to the conventional mode after a head end of the train passes a grade crossing.

6. The system of claim 1 wherein the first onboard system comprises a locomotive interface unit, a location-determining system, and telecommunications equipment

7. The system of claim 6 wherein the first onboard system further comprises a display panel for indicating whether the train is permitted to accelerate at the maximum rate through the downstream grade crossings.

8. The system of claim 1 and further comprising wayside equipment, wherein the wayside equipment includes the wayside interface unit.

9. The system of claim 8 wherein the wayside equipment further includes a grade-crossing prediction controller.

10. A system for use in conjunction with a train and a plurality of railroad-highway grade crossings, wherein the system comprises a wayside system and an onboard system of the train, and wherein said wayside system includes:

at least one wayside interface unit that receives a request from the onboard system to change an operating mode of a grade-crossing controller for each of the plurality of grade crossings from a conventional mode to a motion-sensing mode of operation, wherein in the motion-sensing mode, the grade-crossing controller of each of the grade crossings actuates a respective warning system when a respective approach circuit detects the train, irrespective of an amount of time by which an actual warning time exceeds a configured warning time at each of the grade crossings; and wherein the onboard system comprises a location-determining system, telecommunications equipment, a locomotive interface module, and a track database that are collectively able, when the train is stopped upstream of a grade crossing or under a civil speed restriction, to:

(a) estimate a crossing warning time for each of the grade crossings based on train location, grade-crossing location, train speed, and a maximum allowed acceleration;

(b) send the request to the at least one wayside interface unit when the estimated crossing warning times for each grade crossing meets or exceeds the configured warning time for each of the grade crossings; and (c) provide an indication that the train can accelerate at the maximum allowed rate when an acknowledgment is received that the operating mode of each of the grade-crossing controllers has been changed to the motion-sensing mode.

11. The system of claim 10 and further wherein the onboard system provides an indication that the train is not permitted to accelerate at the maximum allowed rate to a nearest grade crossing when acknowledgment of successful mode change is not received for all the grade crossings from the at least one wayside interface unit.

* * * * *